US010772161B2

(12) United States Patent
Jeanneteau et al.

(10) Patent No.: US 10,772,161 B2
(45) Date of Patent: Sep. 8, 2020

(54) METHOD FOR CONTROLLING AN INDUCTION COOKING HOB INCLUDING A NUMBER OF INDUCTION COILS

(71) Applicant: ELECTROLUX APPLIANCES AKTIEBOLAG, Stockholm (SE)

(72) Inventors: Laurent Jeanneteau, Forli (IT); Massimo Nostro, Forli (IT); Alex Viroli, Forli (IT); Nicola Terracciano, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 278 days.

(21) Appl. No.: 15/572,932

(22) PCT Filed: Jun. 28, 2016

(86) PCT No.: PCT/EP2016/064952
§ 371 (c)(1),
(2) Date: Nov. 9, 2017

(87) PCT Pub. No.: WO2017/005541
PCT Pub. Date: Jan. 12, 2017

(65) Prior Publication Data

US 2018/0146514 A1 May 24, 2018

(30) Foreign Application Priority Data

Jul. 9, 2015 (EP) ..... 15176048

(51) Int. Cl.
*H05B 6/06* (2006.01)

(52) U.S. Cl.
CPC ..... *H05B 6/065* (2013.01); *H05B 2213/03* (2013.01); *H05B 2213/05* (2013.01)

(58) Field of Classification Search
CPC . H05B 6/065; H05B 2213/03; H05B 2213/05
(Continued)

(56) References Cited

U.S. PATENT DOCUMENTS

2009/0250454 A1* 10/2009 Egenter ..... H05B 6/065 219/620
2011/0079591 A1* 4/2011 Parachini ..... H05B 6/065 219/620

(Continued)

FOREIGN PATENT DOCUMENTS

| | | |
|---|---|---|
| EP | 2389045 | 11/2011 |
| EP | 2846607 | 3/2015 |
| WO | 2008122495 | 10/2008 |

OTHER PUBLICATIONS

International Search Report for PCT/EP2016/064952 dated Aug. 22, 2016, 2 pages.

*Primary Examiner* — Benjamin R Shaw
(74) *Attorney, Agent, or Firm* — Pearne & Gordon LLP

(57) ABSTRACT

A method for controlling a cooking hob including induction coils, wherein a heating process includes time cycles subdivided into time slots. The method includes: setting a requested power for each induction coil to be activated by a user, defining a group of induction coils that have the same requested power, determining a number of time slots given by the number of different requested powers, activating all groups of induction coils to be activated during a first time slot at a same current power for a calculated duration, and activating a part of groups of induction coils to be activated during a further time slot at the same current powers in each time slot for a calculated duration if more than one group of induction coils are defined, so that an average current power of each induction coil within the time cycle corresponds with the requested power for the induction coil.

13 Claims, 5 Drawing Sheets

Figure 1:
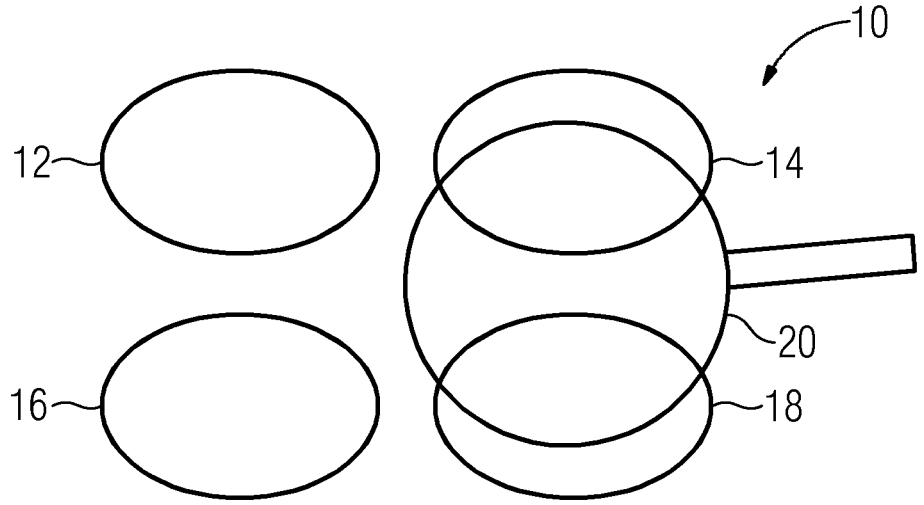

(58) Field of Classification Search
USPC ..... 219/662
See application file for complete search history.

(56) References Cited

U.S. PATENT DOCUMENTS

2011/0187539 A1* 8/2011 Jeanneteau ..... H05B 6/12 340/584
2012/0125918 A1* 5/2012 Bernal Ruiz ..... H05B 6/062 219/622
2012/0248098 A1* 10/2012 Lee ..... H05B 6/065 219/660
2012/0255946 A1* 10/2012 Kim ..... H05B 6/065 219/622
2015/0153049 A1* 6/2015 Jacob ..... F24C 7/083 219/485
2015/0245417 A1* 8/2015 Fattorini ..... H05B 6/44 219/621
2016/0037585 A1* 2/2016 Christiansen ..... H05B 6/065 219/626
2016/0050720 A1* 2/2016 Jeanneteau ..... H05B 6/062 219/445.1
2016/0150597 A1* 5/2016 Yun ..... H05B 6/065 219/624
2016/0157301 A1* 6/2016 Garde Aranda ..... H05B 3/68 219/622
2016/0381736 A1* 12/2016 Christiansen ..... H05B 6/1245 219/624
2018/0063897 A1* 3/2018 Park ..... H05B 6/065
2018/0242406 A1* 8/2018 Yun ..... H05B 6/1236
2018/0242407 A1* 8/2018 Iida ..... H05B 6/1245
2018/0317284 A1* 11/2018 Park ..... H05B 6/1236
2019/0327792 A1* 10/2019 Baldo ..... H05B 6/062

* cited by examiner

METHOD FOR CONTROLLING AN INDUCTION COOKING HOB INCLUDING A NUMBER OF INDUCTION COILS

The present invention relates to a method for controlling an induction cooking hob including a number of induction coils. Further, the present invention relates to an induction cooking hob including a number of induction coils.

Many current induction cooking hobs include number of induction coils forming flexible cooking zones. Said flexible cooking zones may be adapted to the shapes of different cookware. The induction coils are driven by induction generators. The frequency of the induction generator depends on the power of the induction coil. If adjacent induction coils work with a frequency difference within the audible range, then an acoustic interference noise may occur.

It is an object of the present invention to provide a method for controlling an induction cooking hob including a number of induction coils, wherein said method allows the formation of cooking zones by one or more induction coils with a suitable heat distribution, and wherein an acoustic interference noise is avoided.

The object is achieved by the method according to claim 1.

The present invention provides a method for controlling an induction cooking hob including a number of induction coils, wherein a heating process includes a plurality of subsequent fixed time cycles subdivided into one or more flexible time slots, and wherein each induction coil is driven by at least one dedicated induction generator, and wherein the method comprises the following steps:

- setting a requested power for each induction coil to be activated by a user,
- defining at least one group of one or more induction coils, wherein the induction coils of one group have the same requested power,
- determining a number of time slots for each time cycle, wherein the number of time slots is given by the number of groups of induction coils having the same requested power,
- activating all groups of induction coils to be activated during a first time slot at a same current power for a calculated duration, and
- activating a part of groups of induction coils to be activated during at least one further time slot at the same current powers in each time slot for a calculated duration, if more than one group of induction coils are defined,
- so that an average current power of each induction coil within the time cycle corresponds with the requested power for said induction coil.

The core of the present invention is the division of the fixed time cycles into one or more flexible time slots, wherein the induction coils within one time slot work at the same frequency, and wherein the number of time slots is given by the number of groups of induction coils having the same requested power. The same frequencies avoid acoustic interference noise, while the flexible time slots allow that the average current power of each induction coil within the time cycle corresponds with the requested power for said induction coil.

Preferably, the method is provided for controlling an induction cooking hob, wherein the induction coils are arranged as a matrix.

In particular, an array of different requested powers is defined, in which said different requested powers increase, wherein the number of said different requested powers corresponds with the number of time slots in each time cycle, and wherein a corresponding weight array is defined in order to indicate the number of induction coils having the same requested power.

Further, the number of activated induction coils in the first time slot may be given by the number of induction coils to be activated, and the numbers of activated induction coils in the further time slots may be given by:

$$Nic(1)=Num \text{ zones active}$$

$$Nic(i)=Nic(i-1)-w(i-1), \text{ wherein } i>1,$$

and wherein w(i) is the number of activated induction coils in the i-th time slot.

The average power (aP(1)) in the first time slot may be given by:

$$aP(1)=rP(1)*Nic(1),$$

wherein rP(1) is the lowest requested power and Nic(1) is the number of activated induction coils in the first time slot, and the average power in the further time slots i is given by:

$$aP(i)=[rP(i)-rP(i-1)]*Nic(i), \text{ wherein } i>1.$$

The durations of the time slots i may be given by:

$$T(i)=aP(i)/rP,$$

wherein aP(i) is the average power of the induction coils and rP is the total requested power.

The percentage power for each induction coil within one time slot i may be given by:

$$pP(i)=1/Nic(i),$$

wherein Nic(i) is the number of activated induction coils in the i-th time slot.

For example, an estimated power for each induction coil is determined and compared with the requested power for said induction coil, wherein the induction coil is excluded, if the relation between the estimated power and the requested power exceeds a high threshold value and/or falls below a low threshold value.

Furthermore, a power loss for each induction coil may be determined, wherein said power loss is given by the difference between the requested power and the estimated power.

Moreover, the power losses of the induction coils may form a is power loss array, wherein said power loss array is periodically updated.

Preferably, the duration of each time cycle is between three seconds and ten seconds, in particular six seconds.

Further, the present invention relates to an induction cooking hob including a number of induction coils, wherein a heating process performed by said induction cooking hob includes a plurality of subsequent fixed time cycles subdivided into one or more flexible time slots, and wherein the induction cooking hob includes at least one induction generator for each induction coil, so that each induction coil is driven by at least one dedicated induction generator, wherein the induction cooking hob is provided for the method mentioned above.

In particular, the induction coils are arranged as a matrix.

Further, the induction cooking hob may include at least one control unit for controlling the induction generators.

Additionally, the induction cooking hob may include at least one user interface connected or connectable to the control unit.

At last the present invention relates to a computer program stored in a computer usable medium, comprising computer readable program means for causing a computer to perform the method mentioned above.

Novel and inventive features of the present invention are set forth in the appended claims.

Figure 2:
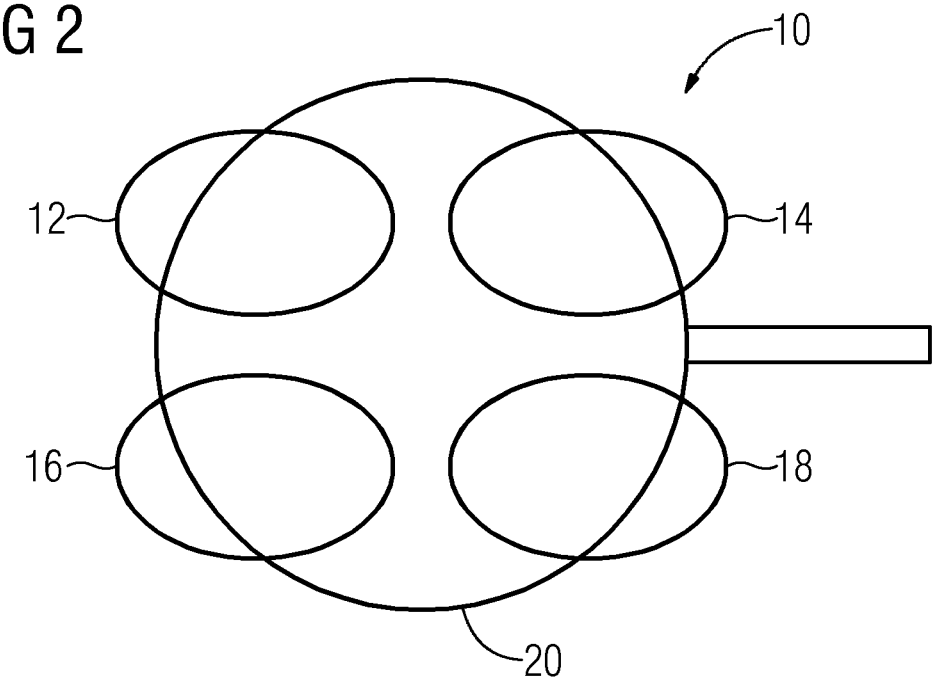
Figure 3:
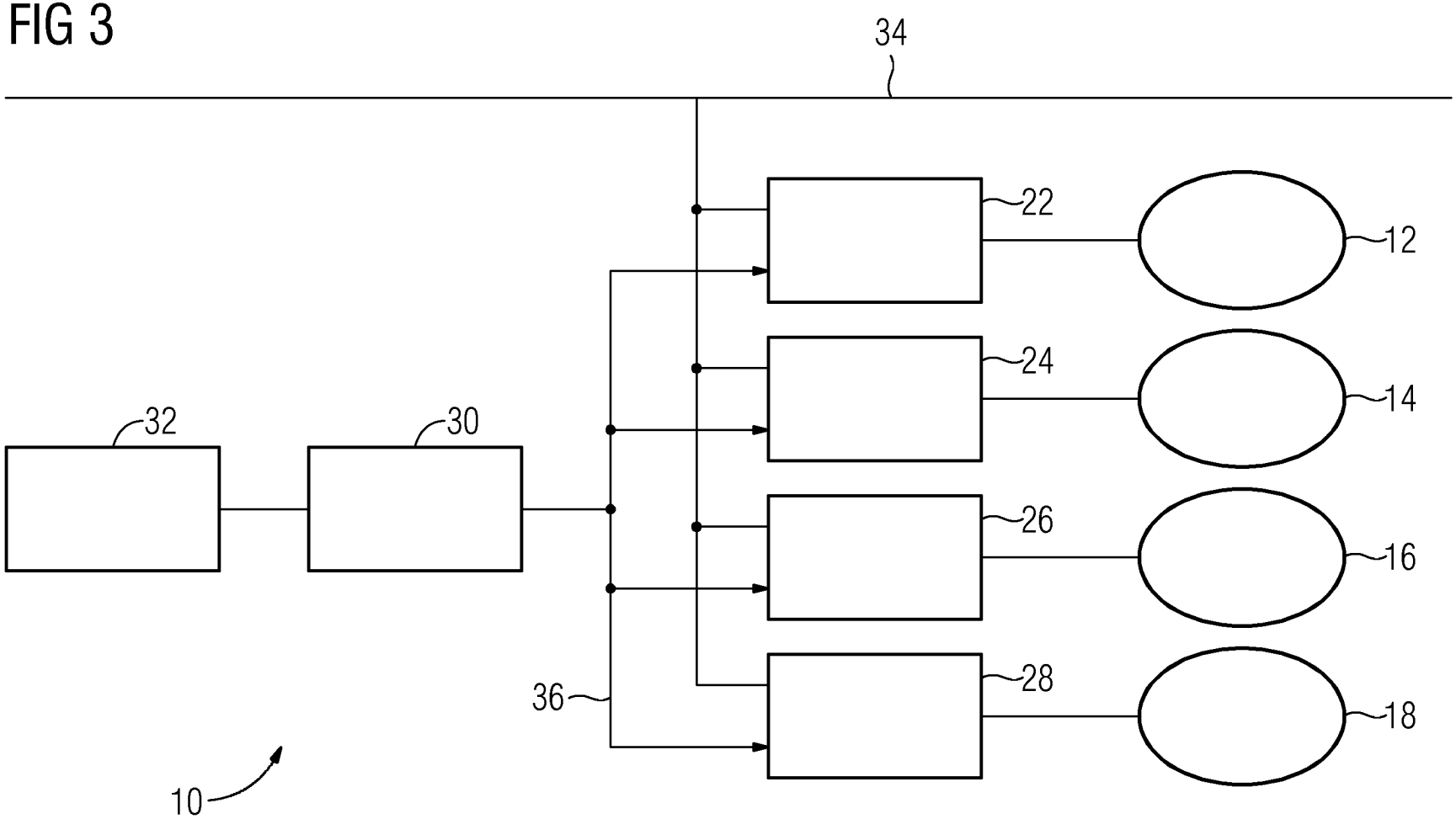
Figure 4:
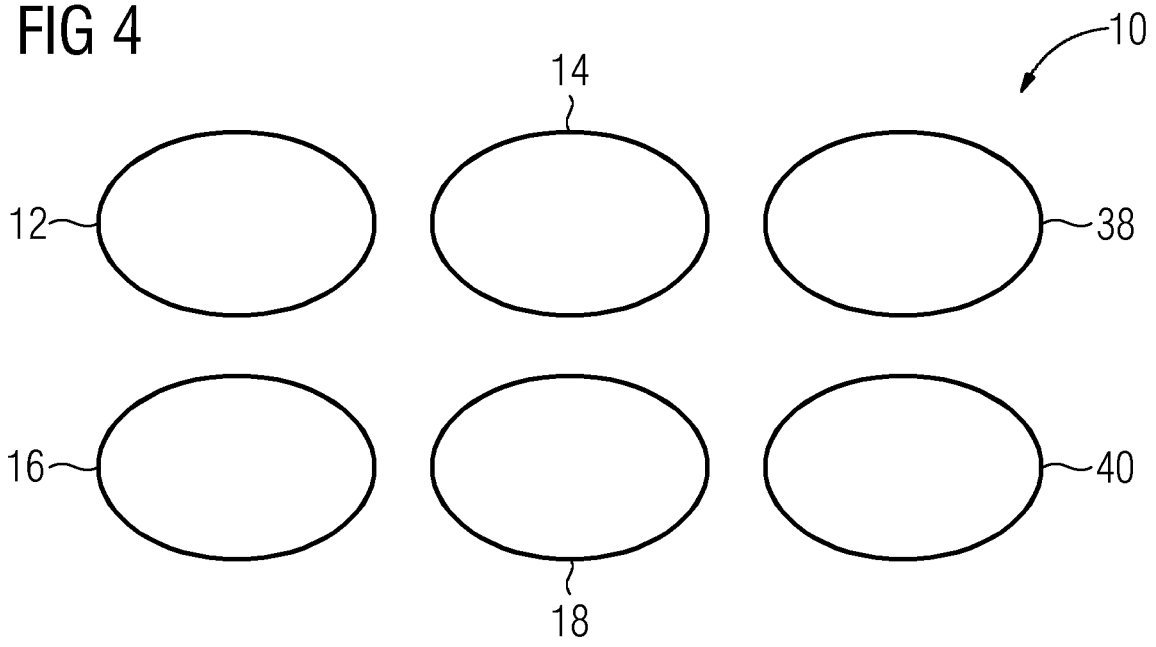
Figure 5:
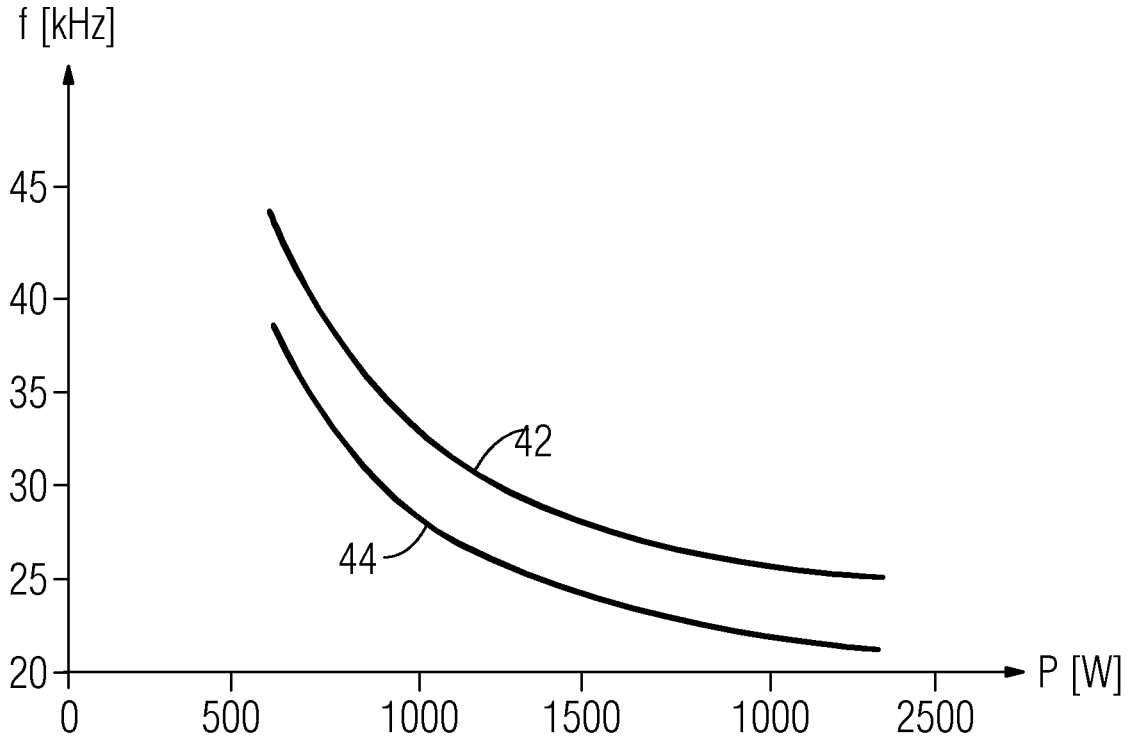
Figure 6:
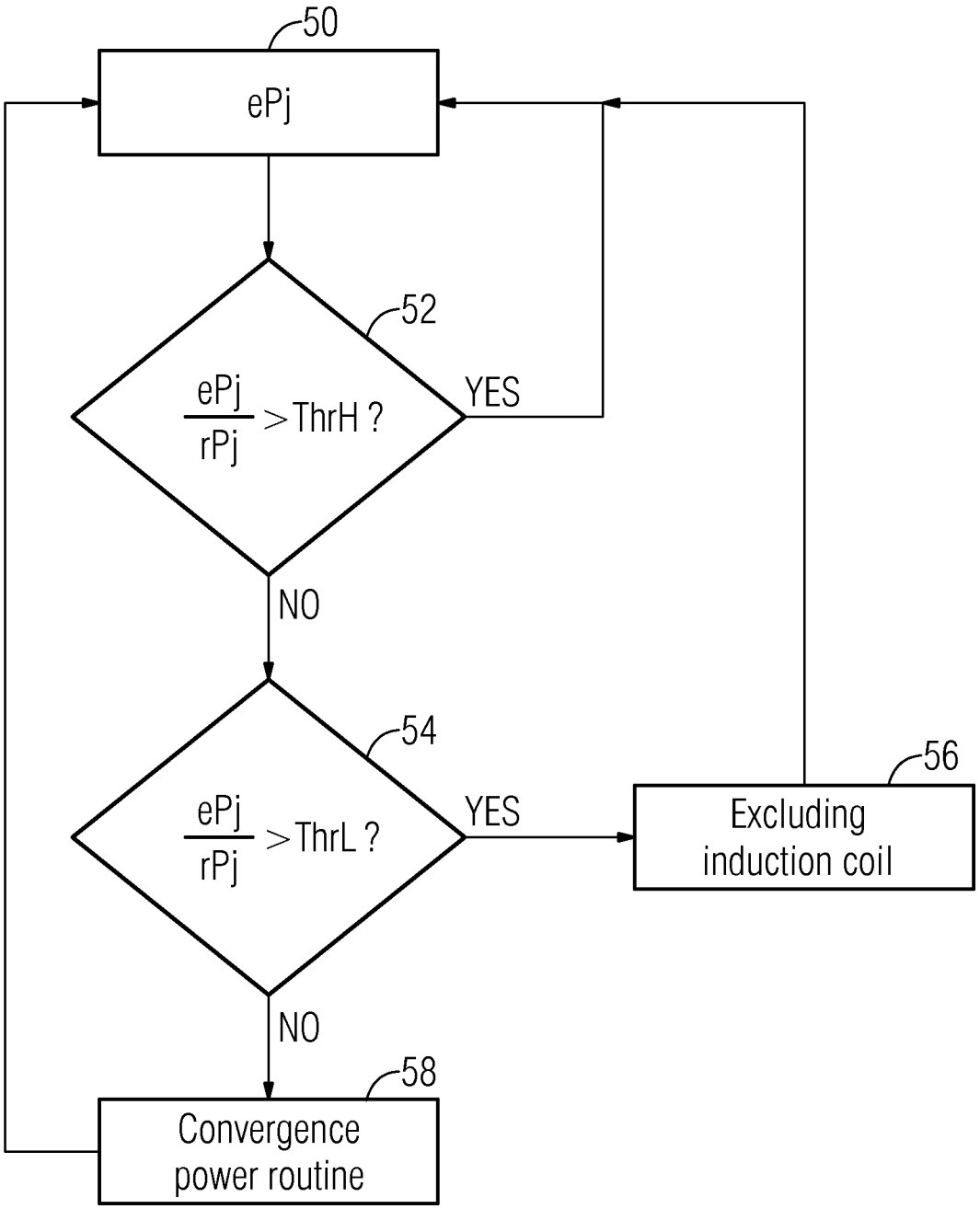
Figure 7:
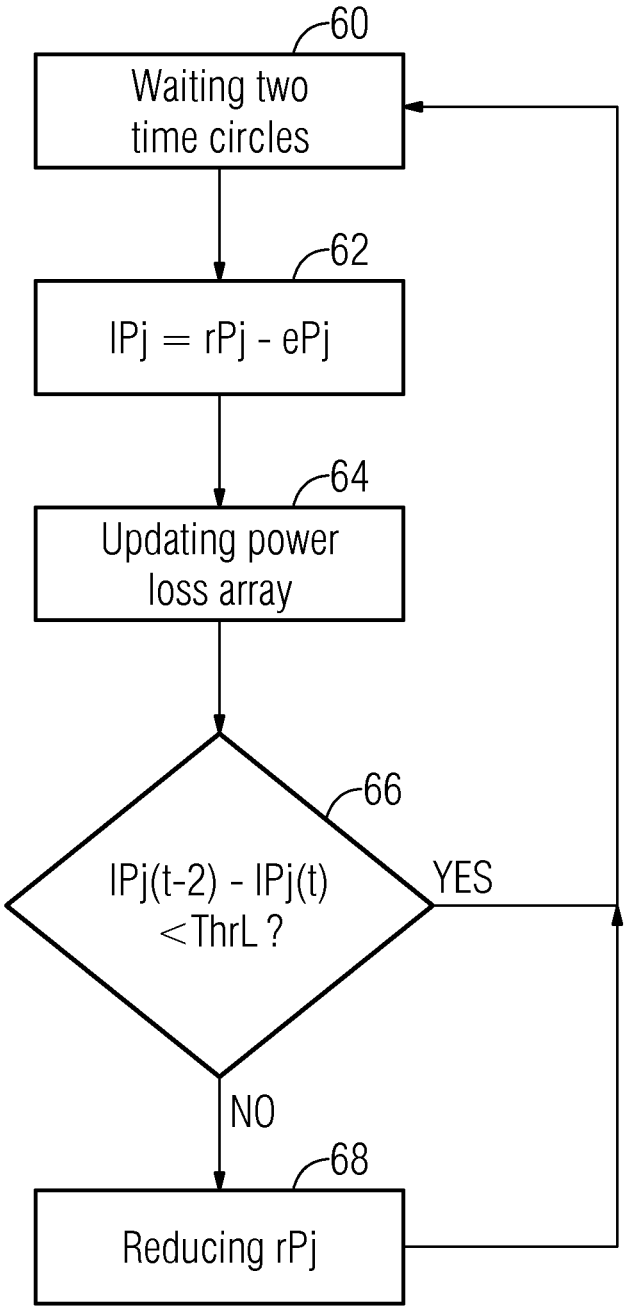

The present invention will be described in further detail with reference to the drawing, in which FIG. 1 illustrates a schematic top view of an induction cooking hob according to a preferred embodiment of the present invention, FIG. 2 illustrates a further schematic top view of the induction cooking hob according to the preferred embodiment of the present invention, FIG. 3 illustrates a schematic block diagram of the induction cooking hob according to the preferred embodiment of the present invention, FIG. 4 illustrates a schematic top view of the induction cooking hob according to a further embodiment of the present invention, FIG. 5 illustrates a schematic diagram of the relationships between the frequency and the power of an induction heating generator according to the preferred embodiment of the present invention, FIG. 6 illustrates a schematic flow chart diagram of an algorithm for evaluating estimated powers of the inductions coils according to the preferred embodiment of the present invention, and FIG. 7 illustrates a schematic flow chart diagram of an algorithm for a convergence power routine according to the preferred embodiment of the present invention.

FIG. 1 illustrates a schematic top view of an induction cooking hob 10 according to a preferred embodiment of the present invention. In this example, the induction cooking hob 10 comprises four induction coils 12, 14, 16 and 18 arranged as a two-by-two matrix. In general, the induction cooking hob 10 may comprise an arbitrary number of induction coils arranged in matrix from. In this example, the induction coils 12, 14, 16 and 18 have elliptic base areas. In general, the induction coils 12, 14, 16 and 18 may have arbitrary base areas. For example, the induction coils 12, 14, 16 and 18 may have circular, square or rectangular base areas.

A frying pan 20 is arranged above the second induction coil 14 and the fourth induction coil 18. In this case, the second induction coil 14 and the fourth induction coil 18 are activated, while the first induction coil 12 and the third induction coil 16 remain deactivated. The heated area of the induction cooking hob 10 can be adapted to the size of the frying pan 20.

FIG. 2 illustrates a further schematic top view of the induction cooking hob 10 according to the preferred embodiment of the present invention. The induction cooking hob 10 comprises the four induction coils 12, 14, 16 and 18 arranged as two-by-two matrix. In this case, the frying pan 20 is arranged above the induction coils 12, 14, 16 and 18. All four induction coils 12, 14, 16 and 18 are activated. The frying pan 20 in FIG. 2 is bigger than the frying pan 20 shown in FIG. 1.

FIG. 3 illustrates a schematic block diagram of the induction cooking hob 10 according to the preferred embodiment of the present invention.

The induction cooking hob 10 comprises the four induction coils 12, 14, 16 and 18. Each of the induction coils 12, 14, 16 and 18 is connected to a dedicated induction generator 22, 24, 26 or 28, respectively. For example, the induction generators 22, 24, 26 or 28 are half-bridge inverters. Each induction generator 22, 24, 26 and 28 is connected to a power supply line 34. Said power supply line 34 provides rectified mains voltage for the induction generators 22, 24, 26 and 28.

Further, the induction generators 22, 24, 26 and 28 are connected to a control unit 30 via control lines 36. Each induction generator 22, 24, 26 and 28 may be separately controlled and activated. Moreover, the control unit 30 is connected to a user interface 32.

As mentioned above, the four induction coils 12, 14, 16 and 18 are arranged as two-by-two matrix. One or more induction coils 12, 14, 16 and 18 form a group of induction coils. The induction coils 12, 14, 16 and 18 of one group work at the same power setting. In doing so induction coils 12, 14, 16 and 18 of one group are activated at the same working frequency in order to avoid acoustic interference noise. The acoustic interference noise would occur, if adjacent induction coils have got a frequency difference, which is within the audible range of the human ear.

The four induction coils 12, 14, 16 and 18 arranged as two-by-two matrix may form five different group configurations. Firstly, the four induction coils 12, 14, 16 and 18 work with a single power setting in each case. Secondly, the four induction coils 12, 14, 16 and 18 form one group. Thirdly, two groups are formed by two induction coils 12, 14, 16 and/or 18 in each case. Fourthly, one group is formed by three induction coils 12, 14, 16 and/or 18 and another one group is formed by one induction coil 12, 14, 16 or 18. Fifthly, one group is formed by two induction coils 12, 14, 16 and/or 18 and two groups are formed by one induction coil 12, 14, 16 or 18 in each case.

An algorithm of the present invention manages the activation of each group of induction coils 12, 14, 16 and/or 18 according to the user's request, wherein acoustic interference noise is avoided. The heating or cooking process includes a plurality of subsequent fixed time cycles, so that each time cycle has the same time period. The time cycle takes between three seconds and ten seconds, preferably six seconds. The time cycle is subdivided into one or more flexible time slots, so that the number and time period of said time slots are variable.

The user sets a requested power rPj for each induction coil 12, 14, 16 and/or 18 to be activated, wherein j denotes the number of the induction coil 12, 14, 16 and 18. The induction coils 12, 14, 16 and/or 18 having the same requested power rPj form a group. The number of groups of induction coils 12, 14, 16 and/or 18 defines the number Nts of the time slots within one time cycle. In other words, the number Nts of time slots is given by the number of inductions coils 12, 14, 16 and/or 18 having different requested powers rP(i) bigger than zero. For example, if the requested powers rPj for the induction coils 12, 14, 16 and 18 are rP1=500 W, rP2=500 W, rP3=1000 W and rP4=1000 W, then the number of time slots is Nts=2 in each time cycle and the different requested powers are rP(1)=500 W and rP(2)=1000 W. In this example, the total requested power is rP=3000 W. The total requested power rP is the sum of the requested powers rPj of all induction coils 12, 14, 16 and 18 to be activated.

The different requested powers rP(i) of the induction coils 12, 14, 16 and 18 to be activated are ordered in an array of requested powers $$\{rP(1), rP(2), rP(3), \ldots, rP(Nts)\}, \text{ wherein } rP(i+1) > rP(i),$$

and wherein Nts is the number of time slots in each time cycle. In the example mentioned above the array of requested powers is given by $$\{rP1 = rP2, rP3 = rP4\} = \{500\text{ W}, 1000\text{ W}\}.$$

Further a corresponding weight array $$\{w(1),w(2)\}=\{2,2\}$$

is defined in order to indicate the number of induction coils 12, 14, 16 and/or 18 having the same requested power rP(i). In this example, the weight array {2, 2} and the array of different requested powers {500 W, 1000 W} indicate that the requested power rP(i) for two induction coils is rP(1)=rP1=rP2=500 W and for the other two induction coils is rP(2)=rP3=rP4=1000 W.

A current power cPj of each induction coil 12, 14, 16 and/or 18 in each time slot and the duration T of each time slot is calculated on the basis of the number of time slots Nts, the array of requested powers and the weight array.

The number Nic(i) of activated induction coils 12, 14, 16 and/or 18 in the time slot i is given by:

$$Nic(1)=Nic,$$

$$Nic(i)=Nic(i-1)-w(i-1), \text{ wherein } i>1,$$

and wherein Nic is the number of induction coils 12, 14, 16 and/or 18 to be activated. The average power aP(i) of each time slot i is given by $$aP(1)=rP(1)*Nic(1),$$

$$aP(i)=[rP(i)-rP(i-1)]*Nic(i), \text{ wherein } i>1.$$

The durations T(i) of the time slots i are given by $$T(i)=aP(i)/rP$$

The percentage power pP(i) for each induction coil 12, 14, 16 and/or 18 within one time slot i is given by $$pP(i)=1/Nic(i).$$

For the example mentioned above the percentage powers pP(i) for each induction coil in each time slot i are given by:

| rPj | time slot 1 T(1) = 0.66 pP(1) | time slot 2 T(2) = 0.33 pP(2) |
|---|---|---|
| 500 W | 0.25 | |
| 500 W | 0.25 | |
| 1000 W | 0.25 | 0.5 |
| 1000 W | 0.25 | 0.5 |

The total requested power rP=3000 W is delivered in two time slots, wherein the duration of the first time slot is T(1)=0.66 and the duration of the second time slot is T(2)=0.33 of the total time cycle. In the first time slot the total power is splitted equally on four induction coils 12, 14, 16 and 18, wherein each induction coil 12, 14, 16 and 18 receives 25% of the total power. In the second time slot the total power is splitted equally on two induction coils 12, 14, 16 and/or 18, wherein said two induction coils 12, 14, 16 and/or 18 receives 50% of the total power.

The current powers cP(i) for each induction coil in the first and second time slots are given by:

| rPj | time slot 1 T(1) = 0.66 cP(1) | time slot 2 T(2) = 0.33 cP(2) | aPj |
|---|---|---|---|
| 500 W | 750 W | | 500 W |
| 500 W | 750 W | | 500 W |
| 1000 W | 750 W | 1500 W | 1000 W |
| 1000 W | 750 W | 1500 W | 1000 W |

According to another example one group of four induction coils 12, 14, 16 and 18 is formed. The requested powers for each induction coil 12, 14, 16 and 18 is rP1=rP2=rP3=rP4=500 W.

The percentage powers pP(i) for each induction coil 12, 14, 16 and 18 in the time slot are given by:

| rPj | time slot 1 T(1) = 1.0 pP(1) |
|---|---|
| 500 W | 0.25 |
| 500 W | 0.25 |
| 500 W | 0.25 |
| 500 W | 0.25 |

In this special case the time cycle includes only one time slot 1. The current powers cP(i) for each induction coil in the one time slot 1 are given by:

| rPj | time slot 1 T(1) = 1.0 cP(1) | aPj |
|---|---|---|
| 500 W | 500 W | 500 W |
| 500 W | 500 W | 500 W |
| 500 W | 500 W | 500 W |
| 500 W | 500 W | 500 W |

According to the next example four induction coils 12, 14, 16 and 18 have different requested powers rP1=200 W, rP2=400 W, rP3=600 W and rP4=800 W. The percentage powers pP(i) for each induction coil 12, 14, 16 and 18 in each time slot i are given by:

| rPj | time slot 1 T(1) = 0.4 pP(1) | time slot 2 T(2) = 0.3 pP(2) | time slot 3 T(3) = 0.2 pP(3) | time slot 4 T(4) = 0.1 pP(4) |
|---|---|---|---|---|
| 200 W | 0.25 | | | |
| 400 W | 0.25 | 0.33 | | |
| 600 W | 0.25 | 0.33 | 0.5 | |
| 800 W | 0.25 | 0.33 | 0.5 | 1.0 |

The current powers cP(i) for the activated induction coils 12, 14, 16 and/or 18 in each time slot i are given by:

| rPj | time slot 1 T(1) = 0.4 cP(1) | time slot 2 T(2) = 0.3 cP(2) | time slot 3 T(3) = 0.2 cP(3) | time slot 4 T(4) = 0.1 cP(4) | aPi |
|---|---|---|---|---|---|
| 200 W | 500 W | | | | 200 W |
| 400 W | 500 W | 660 W | | | 400 W |
| 600 W | 500 W | 660 W | 1000 W | | 600 W |
| 800 W | 500 W | 660 W | 1000 W | 2000 W | 800 W |

In the next example one induction coil 12, 14, 16 or 18 has the requested power rP1=500 W and one group with three induction coils 12, 14, 16 and/or 18 have the requested powers rP2=rP3=rP4=1000 W. The percentage powers pP(i) for the activated induction coils 12, 14, 16 and/or 18 in each time slot are given by:

| rPi | time slot 1 T(1) = 0.57 pP(1) | time slot 2 T(2) = 0.43 pP(2) |
|---|---|---|
| 500 W | 0.25 | |
| 1000 W | 0.25 | 0.33 |
| 1000 W | 0.25 | 0.33 |
| 1000 W | 0.25 | 0.33 |

The current powers cP(i) for activated induction coils 12, 14, 16 and/or 18 in each time slot i are given by:

| rPi | time slot 1 T(1) = 0.57 cP(1) | time slot 2 T(2) = 0.43 cP(2) | aPj |
|---|---|---|---|
| 500 W | 875 W | | 500 W |
| 1000 W | 875 W | 1155 W | 1000 W |
| 1000 W | 875 W | 1155 W | 1000 W |
| 1000 W | 875 W | 1155 W | 1000 W |

According to a further example two single induction coils 12, 14, 16 and/or 18 have the requested power rP1=500 W and rP2=700 W and one group with two induction coils 12, 14, 16 and/or 18 have the requested power rP3=rP4=1000 W. The percentage powers pP(i) for the activated induction coils 12, 14, 16 and/or 18 in each time slot are given by:

| rPj | time slot 1 T(1) = 0.625 pP(1) | time slot 2 T(2) = 0.188 pP(2) | time slot 2 T(3) = 0.187 pP(2) |
|---|---|---|---|
| 500 W | 0.25 | | |
| 700 W | 0.25 | 0.33 | |
| 1000 W | 0.25 | 0.33 | 0.5 |
| 1000 W | 0.25 | 0.33 | 0.5 |

The current powers cP(i) for activated induction coils 12, 14, 16 and/or 18 in each time slot i are given by:

| rPj | time slot 1 T(1) = 0.625 cP(1) | time slot 2 T(2) = 0.188 cP(2) | time slot 2 T(3) = 0.187 cP(3) | aPj |
|---|---|---|---|---|
| 500 W | 800 W | | | 500 W |
| 700 W | 800 W | 1056 W | | 700 W |
| 1000 W | 800 W | 1056 W | 1600 W | 1000 W |
| 1000 W | 800 W | 1056 W | 1600 W | 1000 W |

FIG. 4 illustrates a schematic top view of the induction cooking hob 10 according to a further embodiment of the present invention. The induction cooking hob 10 comprises six induction coils 12, 14, 16, 18, 38 and 40 arranged as a two-by-three matrix.

According to an example the induction coils 12, 14, 16, 18, 38 and 40 have the requested powers rP1=200 W, rP2=200 W, rP3=300 W, rP4=300 W, rP5=400 W and rP6=700 W. Thus, the total requested power of the induction coils 12, 14, 16, 18, 38 and 40 is rP=2100 W. Since two pairs of induction coils 12 and 14 as well as 16 and 18 have the same requested powers rPj in each case, the power array is given by $$\{200\text{ W},300\text{ W},400\text{ W},700\text{ W}\},$$

and the weight array is given by $$\{w(1),w(2),w(3),w(4)\}=\{2,2,1,1\}.$$

There are four groups of induction coils 12, 14, 16, 18, 38 and 40. The number of time slots corresponds with said number of groups:

$$Nts=4.$$

The numbers Nic(i) of activated induction coils 12, 14, 16, 18, 38 and/or 40 for the time slots i are given by:

$$Nic(1)=Nic=6,$$

$$Nic(2)=Nic(1)-w(1)=6-2=4,$$

$$Nic(3)=Nic(2)-w(2)=4-2=2,$$

$$Nic(4)=Nic(3)-w(3)=2-1=1.$$

The average powers aP(i) for the time slots i are given by $$aP(1)=rP(1)*Nic(1)=200\text{ W}*6=1200\text{ W},$$

$$aP(2)=[rP(2)-rP(1)]*Nic(2)=(300\text{ W}-200\text{ W})*4=400\text{ W},$$

$$aP(3)=[rP(3)-rP(2)]*Nic(3)=(400\text{ W}-300\text{ W})*2=200\text{ W},$$

$$aP(4)=[rP(4)-rP(3)]*Nic(4)=(700\text{ W}-400\text{ W})*1=300\text{ W}.$$

The durations T(i) of the time slots i are given by $$T(1)=aP(1)/rP=1200\text{ W}/2100\text{ W}=0.57,$$

$$T(2)=aP(2)/rP=400\text{ W}/2100\text{ W}=0.19,$$

$$T(3)=aP(3)/rP=200\text{ W}/2100\text{ W}=0.09,$$

$$T(4)=aP(4)/rP=300\text{ W}/2100\text{ W}=0.15.$$

The percentage powers pPi for each induction coil in each time slot are given by:

$$pP(1)=1/Nic(1)=1/6=0.16,$$

$$pP(2)=1/Nic(2)=1/4=0.5,$$

$$pP(3)=1/Nic(3)=1/2=0.25,$$

$$pP(4)=1/Nic(4)=1/1=1.$$

The percentage powers pPi for each induction coil in each time slot are shown in detail below:

| rPj | time slot 1 T(1) = 0.57 pP(1) | time slot 2 T(2) = 0.19 pP(2) | time slot 3 T(3) = 0.09 pP(3) | time slot 4 T(4) = 0.15 pP(4) |
|---|---|---|---|---|
| 200 W | 0.16 | | | |
| 200 W | 0.16 | | | |
| 300 W | 0.16 | 0.25 | | |
| 300 W | 0.16 | 0.25 | | |
| 400 W | 0.16 | 0.25 | 0.5 | |
| 700 W | 0.16 | 0.25 | 0.5 | 1.0 |

The current powers cP(i) for the activated induction coils in each time slot are given by:

| rPj | time slot 1 T(1) = 0.57 cP(1) | time slot 2 T(2) = 0.19 cP(2) | time slot 3 T(3) = 0.09 cP(3) | time slot 4 T(4) = 0.15 cP(4) | aPj |
|---|---|---|---|---|---|
| 200 W | 336 W | | | | 200 W |
| 200 W | 336 W | | | | 200 W |
| 300 W | 336 W | 525 W | | | 300 W |
| 300 W | 336 W | 525 W | | | 300 W |
| 400 W | 336 W | 525 W | 1050 W | | 400 W |
| 700 W | 336 W | 525 W | 1050 W | 2100 W | 700 W |

FIG. 5 illustrates a schematic diagram of the relationships 42 and 44 between the frequency f and the power P of an induction heating generator 22, 24, 26 and/or 28 according to the preferred embodiment of the present invention.

A first diagram 42 shows the relationship between the frequency f and the power P of the induction heating generator 22, 24, 26 and/or 28 for the case, in which a cooking pot substantially covers the corresponding induction coil. A second diagram 44 shows the relationship between the frequency f and the power P of the induction heating generator 22, 24, 26 and/or 28 for the case, in which the cooking pot has a bad coverage of the corresponding induction coil. In the latter case the power delivered to the cooking pot is lower than expected. Adjacent induction coils have the same requested powers and run at the same frequencies, so that the performances of adjacent induction coils could be limited.

In order to avoid the bad coverage of the cooking pot on the corresponding induction coil 12, 14, 16, 18, 38 and/or 40 a power estimation and adjustment loop is provided.

FIG. 6 illustrates a schematic flow chart diagram of an algorithm for evaluating estimated powers of the inductions coils 12, 14, 16, 18, 38 and/or 40 according to the preferred embodiment of the present invention.

In a first step 50 the real powers ePj of each induction coil j are estimated. In a next step 52 the relation between the estimated power ePj and requested power rPj of each induction coil j is compared with a predetermined high threshold value ThrH. For example, said high threshold value ThrH is about 70%. If the relation between the estimated power ePj and requested power rPj of the induction coil j is bigger than the high threshold value ThrH, then step 50 is activated again. If the relation between the estimated power ePj and requested power rPj of the induction coil j is smaller than the high threshold value ThrH, then a further step 54 is activated.

In the step 54 the relation between the estimated power ePj and requested power rPj of the induction coil j is compared with a predetermined low threshold value ThrL. For example, said low threshold value ThrL is about 30%. If the relation between the estimated power ePj and requested power rPj of the induction coil j is smaller than the low threshold value ThrL, then the induction coil j is excluded in step 56. If the relation between the estimated power ePj and requested power rPj of the induction coil j is bigger than the low threshold value ThrL, then a convergence power routine is performed in step 58.

FIG. 7 illustrates a schematic flow chart diagram of an algorithm for a convergence power routine 58 according to the preferred embodiment of the present invention.

As a first step 60 a time warp is performed. In this example, the time wrap extends two time cycles. In a next step 62 a power loss lPj of each induction coil j is calculated. A total power loss is given by the sum of power losses lPj of all activated induction coils j. In a further step 64 the power losses lPj are ordered into a power loss array $$\{lP1, lP2, lP3, \ldots, lP(Nic)\},$$

wherein the power losses lPj are ordered from the highest to the lowest values of the power losses lPj. The power loss array is ordered and updated again after a certain time in particular every two time cycles. In a next step 66 a decrease of the power loss lPj after two time cycles is checked. If said decrease is smaller than a threshold value Thr, then the convergence power routine returns to step 60. If the decrease of the power loss lPj is bigger than the threshold value Thr, then the requested power rPj is reduced in a step 68. In the step 68 the requested power rPj is reduced of a quantity equal to a certain percentage quotation of the power loss of the induction coil j. The decrement of the requested power of the induction coil j is stopped, when lPj is decreasing within the threshold value Thr. Further, the original requested power is checked periodically in order to avoid a permanent reduction of power.

Although an illustrative embodiment of the present invention has been described herein with reference to the accompanying drawing, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 induction cooking hob
12 first induction coil
14 second induction coil
16 third induction coil
18 fourth induction coil
20 frying pan
22 first induction generator
24 second induction generator
26 third induction generator
28 fourth induction generator
30 control unit
32 user interface
34 power supply line
36 control line
38 fifth induction coil
40 sixth induction coil
42 diagram of frequency as function of the delivered power
44 diagram of frequency as function of the delivered power
50 step of estimating the power
52 step of comparing the estimated power
54 step of further comparing the estimated power
56 step of excluding the induction coil
58 step of performing the convergence power routine
60 step of time warp

62 step of calculating the power loss
64 step of updating the power loss array
66 step of checking the decrease of power
68 step of reducing the requested power
P power of an induction coil
rP total requested power of the induction coils
rPj requested power of the j-th induction coil
pP(i) percentage power of each induction coil in the time slot i
cP(i) current power of each induction coil in the time slot i
aPj average power of the j-th induction coil
Nts number of time slots
Nic number of induction coils to be activated
Nic(i) number of activated induction coils in the time slot i
ts time slot
T(i) duration of time slot i
f frequency
ePj estimated power of the j-th induction coil
ThrH high threshold value
ThrL low threshold value
lPj power loss of the j-th induction coil
Thr threshold value for the decrease of power loss

The invention claimed is:

1. A method for controlling an induction cooking hob (10) including a number of induction coils (12, 14, 16, 18; 38, 40), wherein a heating process includes a plurality of subsequent fixed time cycles subdivided into one or more flexible time slots (ts), and wherein each induction coil (12, 14, 16, 18; 38, 40) is driven by at least one dedicated induction generator (22, 24, 26, 28), and wherein the method comprises the following steps:

setting a requested power (rPj) for each induction coil (12, 14, 16, 18; 38, 40) to be activated by a user, defining at least one group of one or more induction coils (12, 14, 16, 18; 38, 40), wherein the induction coils (12, 14, 16, 18; 38, 40) of one group have the same requested power (rPj), determining a number of time slots (Nts) for each time cycle, wherein the number of time slots (Nts) is given by the number of groups of induction coils (12, 14, 16, 18; 38, 40) having the same requested power (rPj), activating all groups of induction coils (12, 14, 16, 18; 38, 40) to be activated during a first time slot (ts1) at a same current power (cP(1)) for a calculated duration (T(1)), and activating a part of groups of induction coils (12, 14, 16, 18; 38, 40) to be activated during at least one further time slot (ts2, ts3, ts4) at the same current powers (cP(2), cP(3), cP(4)) in each time slot (ts2, ts3, ts4) for a calculated duration (T(2), T(3), T(4)), if more than one group of induction coils (12, 14, 16, 18; 38, 40) are defined, so that an average current power (aPj) of each induction coil (12, 14, 16, 18; 38, 40) within the time cycle corresponds with the requested power (rPj) for said induction coil (12, 14, 16, 18; 38, 40).

2. The method according to claim 1, characterised in that the method is provided for controlling an induction cooking hob (10), wherein the induction coils (12, 14, 16, 18; 38, 40) are arranged as a matrix.

3. The method according to claim 1, characterised in that an array ({rP(1), rP(2), rP(3), . . . , rP(Nts)}) of different requested powers (rP(i)) is defined, in which said different requested powers increase, wherein the number of said different requested powers (rP(i)) corresponds with the number of time slots (Nts) in each time cycle, and wherein a corresponding weight array ({w(1), w(2), . . . , w(Nts)}) is defined in order to indicate the number of induction coils (12, 14, 16, 18; 38, 40) having the same requested power (rP(i)).

4. The method according to claim 1, characterised in that the number (Nic(1)) of activated induction coils (12, 14, 16, 18; 38, 40) in the first time slot is given by the number (Nic) of induction coils (12, 14, 16, 18; 38, 40) to be activated, and the number (Nic(i)) of activated induction coils (12, 14, 16, 18; 38, 40) in the further time slots is given by: Nic(i)=Nic(i−1)−w(i−1), wherein i>0, and wherein w(i) is the number of activated induction coils (12, 14, 16, 18; 38, 40) in the i-th time slot.

5. The method according to claim 1, characterised in that the average power (aP(1)) in the first time slot is given by:

$$aP(1)=rP(1)*\mathrm{Nic}(1),$$

wherein rP(1) is the lowest requested power and Nic(1) is the number of activated induction coils (12, 14, 16, 18; 38, 40) in the first time slot, and the average power (aP(1)) in the further time slots (i) is given by:

$$aP(i)=[rP(i)-rP(i-1)]*\ Nic(i),\ \text{wherein}\ i>0.$$

6. The method according to claim 1, characterised in that the durations (T(i)) of the time slots (i) are given by:

$$T(i)=aP(i)/rP,$$

wherein aP(i) is the average power of the induction coils (12, 14, 16, 18; 38, 40) and rP is the total requested power.

7. The method according to claim 1, characterised in that the percentage power (pP(i)) for each induction coil (12, 14, 16, 18; 38, 40) within one time slot (i) is given by:

$$pP(i)=1/Nic(i),$$

wherein Nic(i) is the number of activated induction coils in the i-th time slot.

8. The method according to claim 1, characterised in that the duration of each time cycle is between three seconds and ten seconds.

9. An induction cooking hob (10) including a number of induction coils (12, 14, 16, 18; 38, 40), said induction cooking hob (10) being configured to perform a heating process including a plurality of subsequent fixed time cycles subdivided into one or more flexible time slots (ts), and wherein the induction cooking hob (10) includes at least one induction generator (22, 24, 26, 28) for each induction coil (12, 14, 16, 18; 38, 40), so that each induction coil (12, 14, 16, 18; 38, 40) is driven by at least one dedicated induction generator (22, 24, 26, 28), and wherein the induction cooking hob (10) includes a control unit (30) configured to:

set a requested power (rPj) for each induction coil (12, 14, 16, 18; 38, 40) to be activated by a user, define at least one group of one or more induction coils (12, 14, 16, 18; 38, 40), wherein the induction coils (12, 14, 16, 18; 38, 40) of one group have the same requested power (rPj), determine a number of time slots (Nts) for each time cycle, wherein the number of time slots (Nts) is given by the number of groups of induction coils (12, 14, 16, 18; 38, 40) having the same requested power (rPj), activate all groups of induction coils (12, 14, 16, 18; 38, 40) to be activated during a first time slot (tsl) at a same current power (cP(1)) for a calculated duration (T(1)), and activate a part of groups of induction coils (12, 14, 16, 18; 38, 40) to be activated during at least one further time slot (ts2, ts3, ts4) at the same current powers (cP(2), cP(3), cP(4)) in each time slot (ts2, ts3, ts4) for a calculated duration (T(2), T(3), T(4)), if more than one group of induction coils (12, 14, 16, 18; 38, 40) are defined, so that an average current power (aPj) of each induction coil (12, 14, 16, 18; 38, 40) within the time cycle corresponds with the requested power (rPj) for said induction coil (12, 14, 16, 18; 38, 40).

10. The induction cooking hob according to claim 9 characterised in that the induction coils (12, 14, 16, 18; 38, 40) are arranged as a matrix.

11. The induction cooking hob according to claim 9, wherein the induction cooking hob (10) includes at least one user interface (32) connected or connectable to the control unit (30).

12. A non-transitory computer readable medium having a program stored therein, for causing a computer to perform a method according to claim 1.

13. The method according to claim 1, characterised in that the duration of each time cycle is six seconds.

* * * * *